United States Patent [19]

Collins

[11] 4,442,559

[45] Apr. 17, 1984

[54] UTILITY KNIFE

[75] Inventor: Walter W. Collins, Rock Hill, S.C.

[73] Assignee: Jenkins Metal Corporation, Gastonia, N.C.

[21] Appl. No.: 279,789

[22] Filed: Jul. 2, 1981

[51] Int. Cl.[3] ..... B26B 11/00

[52] U.S. Cl. ..... 7/158; 30/153

[58] Field of Search ..... 7/138, 142, 158, 165, 7/169; 30/151, 153, 155, 314, 340

[56] References Cited

U.S. PATENT DOCUMENTS

| | | | |
|---|---|---|---|
| 64,662 | 5/1867 | Gold | 7/169 X |
| 1,609,732 | 12/1926 | McLaughlin et al. | 7/169 X |
| 2,280,463 | 4/1942 | Williamson | 7/158 |
| 2,859,516 | 11/1958 | McQueary | 30/151 |
| 2,901,823 | 9/1959 | Widen | 30/151 |
| 2,951,482 | 9/1960 | Sullivan | 30/340 X |
| 3,461,469 | 8/1969 | Morrison | 7/142 X |
| 3,524,570 | 8/1970 | Seguine | 30/151 X |
| 4,283,854 | 8/1981 | Austin | 30/340 X |

FOREIGN PATENT DOCUMENTS

| | | | |
|---|---|---|---|
| 105650 | 10/1942 | Norway | 7/158 |

*Primary Examiner*—James G. Smith

*Attorney, Agent, or Firm*—Clifton Ted Hunt

[57] ABSTRACT

A utility knife comprising a fixed blade and a tool-shaped shank with a pivotally mounted housing selectively movable between a first position about one edge of the shank to use the knife-blade and a second position about one edge of the blade to use the shank as a tool.

10 Claims, 18 Drawing Figures

24
27
21
23
37
20
36
57
52
58
46
25
56
48
45
55
28
61
53
54
50
47
60
26
29
22
51
33
30
38
31
32
39
59
8
7

UTILITY KNIFE

BACKGROUND OF THE INVENTION

Multi-purpose knives have long been known, such as the popular and well known "Boy Scout knife" with its several knife blades, screwdriver, corkscrew, bottle opener, scissors and perhaps other tools all arranged in juxtaposition within a common housing when not in use. The tools and blades are pivotally connected to the ends of the housing, which must be of sufficient width to accomodate the desired number of juxtaposed tools and blades, sometimes resulting in a cumbersome and unwieldly structure. The selected tool or blade is conventionally removed from the housing by pivoting it relative to the housing until it extends at a desired angularity from the housing, at which point the tool or blade engages an abutment to prevent further relative movement of the tool or blade away from the housing. Pivotal movement of the blade or tool in the opposite direction returns it to the housing. Such a pivotal relation of the tools and blades to the housing renders the tools and blades inoperative when pressure is applied to them in a direction intended to return them to the housing.

The housing of the prior art multi-purpose knives is of channel-shaped configuration to receive the juxtaposed tools and blades and functions as a shank or handle of the elected and extended blade or tool. The housing is not shaped as a tool and does not function as a tool.

SUMMARY OF THE INVENTION

The utility knife of the present invention is structured for multi-purpose use and comprises material such as steel of a desired hardness shaped to define a knife blade at a first end portion and a shank or handle integrally including one or more tools at the second or other end of the material. The knife blade and tools are axially alined or spaced longitudinally from each other and are not juxtaposed as in the prior art. In the illustrated embodiment of the invention, the handle of the knife is flat and the tools comprise several different sized hexagon-shaped openings intended to fit over correspondingly sized nuts to function as wrenches. Another example of a tool is to form saw teeth along one edge of the handle or along the back of the blade.

A channel shaped or U-shaped housing is provided for selective pivotal movement into a first position over one edge of the handle and into a second position over a sharpened edge of the knife. The knife blade and its tool-shaped shank are of approximately equal length and one end of a positioning link is pivotally connected to the end portion of the shank proximate to the knife blade. The other end of the positioning link is pivotally connected to the housing. The pivotal connection of the housing to the tool portion of the integral structure enables the housing to be selectively pivoted over the sharpened blade of the knife or over the opposite edge of the axially extending tool shaped shank. In practice, the housing covers the sharpened blade of the knife when it is desired to use the structure as a tool and the housing covers one edge portion of the tool-shaped shank when it is desired to use the structure as a knife.

It is an object of the invention to provide a multi-purpose knife including a knife blade with a sharpened edge and a tool-shaped shank arranged in axial alignment with each other and formed from a single piece of steel to define an integrated structure.

It is another object of this invention to provide a structure of the type described wherein means are provided for selectively housing the sharpened blade of the knife when it is desired to use the integrated structure as a tool and for selectively housing one edge of the tool when it is desired to use the integrated structure as a knife.

It is a more specific object of this invention to provide a structure of the type described which includes a positioning link pivotally connected at one end to one end of the housing and pivotally connected at its other end to the medial portion of the integrated structure.

It is a more specific object of the invention to provide a structure of the type described wherein the housing is of U-shaped configuration, the positioning link includes a pair of arms extending in spaced parallel relation to each other on opposite sides of the knife blade and its shank, means pivotally connecting one end of the positioning link to an angular end portion of the housing to form a pivotal connection and means pivotally connecting the other end of the positioning link to the shank adjacent the blade.

It is a further object of this invention to provide a utility knife of the type described wherein means are provided for releasably retaining the housing about the sharpened blade of the knife when the housing is manipulated to cover the blade for use of the tool-shaped shank.

It is another object of the invention to provide means limiting movement of the housing about the tool portion of the structure when it is desired to use the knife blade.

Another object of the invention is to provide a utility knife including a knife blade and axially aligned tool-shaped shank which may be used as a knife by grasping the shank and which may be used as a tool by grasping the knife blade.

It is another object of the invention to provide a knife of the type last described which includes a sheath for the knife and wherein the sheathed blade of the knife may be grasped for use of the tool-shaped shank.

Another object of the invention is to provide a knife and sheath of the type described which includes means for supporting the sheath with the knife depending downwardly from the sheath and means for releasably retaining the knife blade within the sheath.

Another object of the invention is to provide a knife and sheath of the type described wherein the means for releasably retaining the knife blade within the sheath includes a stud projecting from the sheath toward the shank of the knife and the shank of the knife having a hole therethrough to receive the stud.

Some of the objects having been stated, other objects will appear to those skilled in the art when reading the following description in connection with the accompanying drawings.

DETAILED DESCRIPTION OF THE INVENTION

Figures 1, 2:
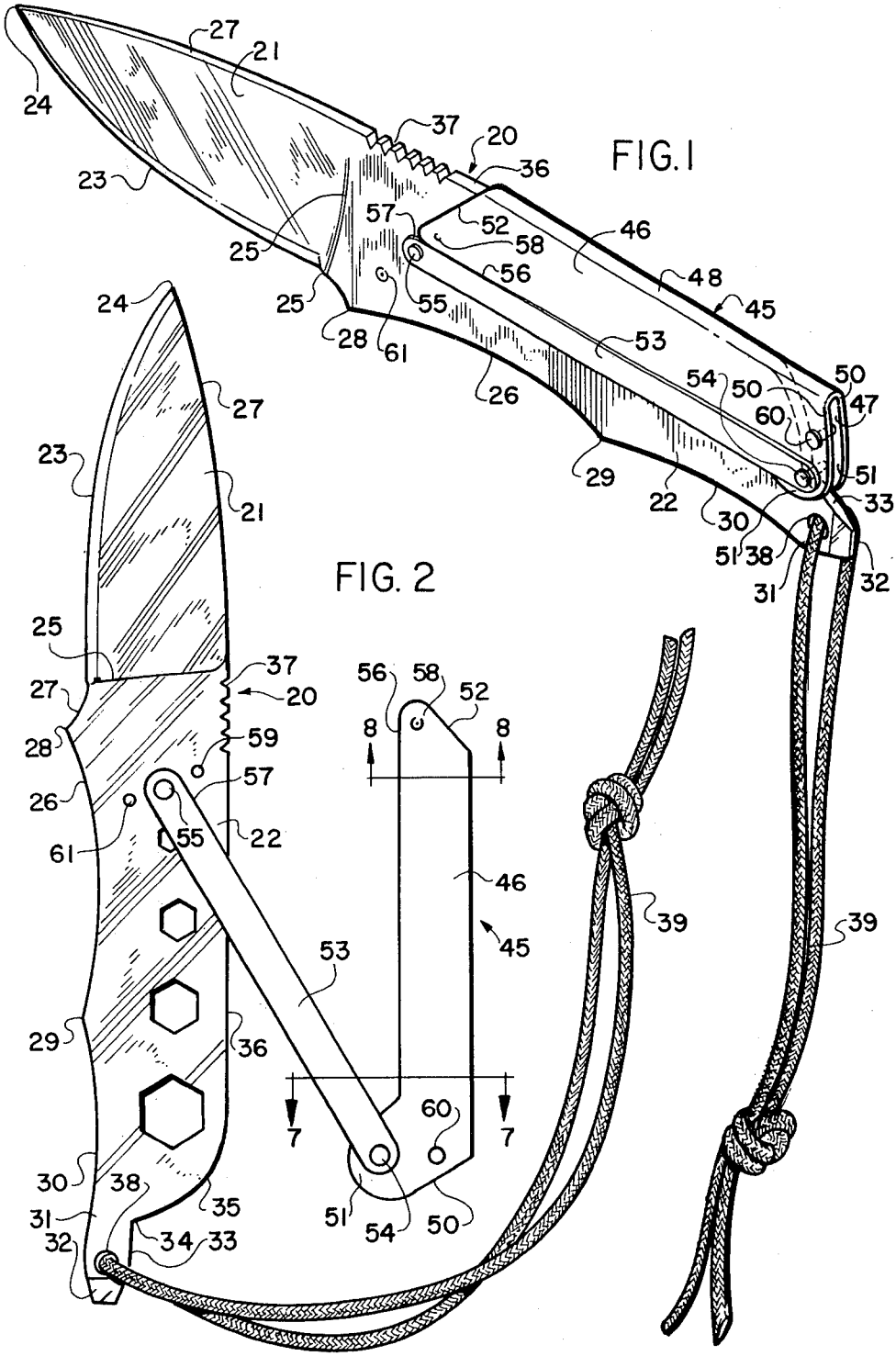
FIG. 1 is a perspective view of the utility knife illustrating the housing positioned about one edge of the tool-shaped shank for the use of the knife blade.
FIGS. 2, 3, 4 and 5, are sequential views illustrating the movement of the housing from a first operative position about the tool-shaped shank as shown in FIG. 1 to its second operative position about the sharpened edge of the knife as shown in FIG. 5.

Referring more specifically to the drawings, the numeral 20 broadly represents a utility knife comprising a knife blade 21 and tool-shaped shank 22 formed as an integral unit from a single piece of metal such as steel. The knife blade 21 may be of any desired structure and configuration but the exemplary illustrated embodiment of the knife blade 21 includes a sharpened edge 23 which extends from a pointed end 24 of the blade and merges as at 25 with the flat bottom edge 26 of the shank 22.

The shank 22 has an outer configuration shaped to define a convenient handle for the knife blade 21. In the illustrated embodiment the flat bottom edge 26 of the shank extends rearwardly in a shallow arc along a line 27 from the merger of the shank with the blade 21 to a point 28. The bottom edge 26 curves inwardly and rearwardly from the point 28 to a second point 29 rearwardly of the longitudinal mid-point of the shank 22. The flat bottom edge 26 again curves inwardly and rearwardly along a line 30 which merges with and defines the bottom wall of a rearwardly extending tang or projection 31 formed integral with the shank 22.

The tang 31 terminates in a straight edge 32 extending generally perpendicular to the line 30 and shaped as at 32 (FIGS. 1 and 6) to define the working end of a screwdriver. A flat top wall 33 of the tang 31 extends from the shaped end 32 and merges at 34 with a flat arcuate rear wall 35 extending outwardly and forwardly from its merger with the tang 33 at the point 34. The outer configuration of the shank 22 is completed by a flat straight top wall 36 merging with the arcuate rear wall 35 and extending forwardly to its juncture with the flat top wall or blunt edge 19 of the blade 21 along the merging line 25. The forward portion of the top wall 36 is preferably serrated as by transverse grooves 37 to provide a convenient thumb grip. The tang 31 has a transverse bore or opening 38 extending therethrough for reception of a thong or lanyard 39.

Figures 5, 6:
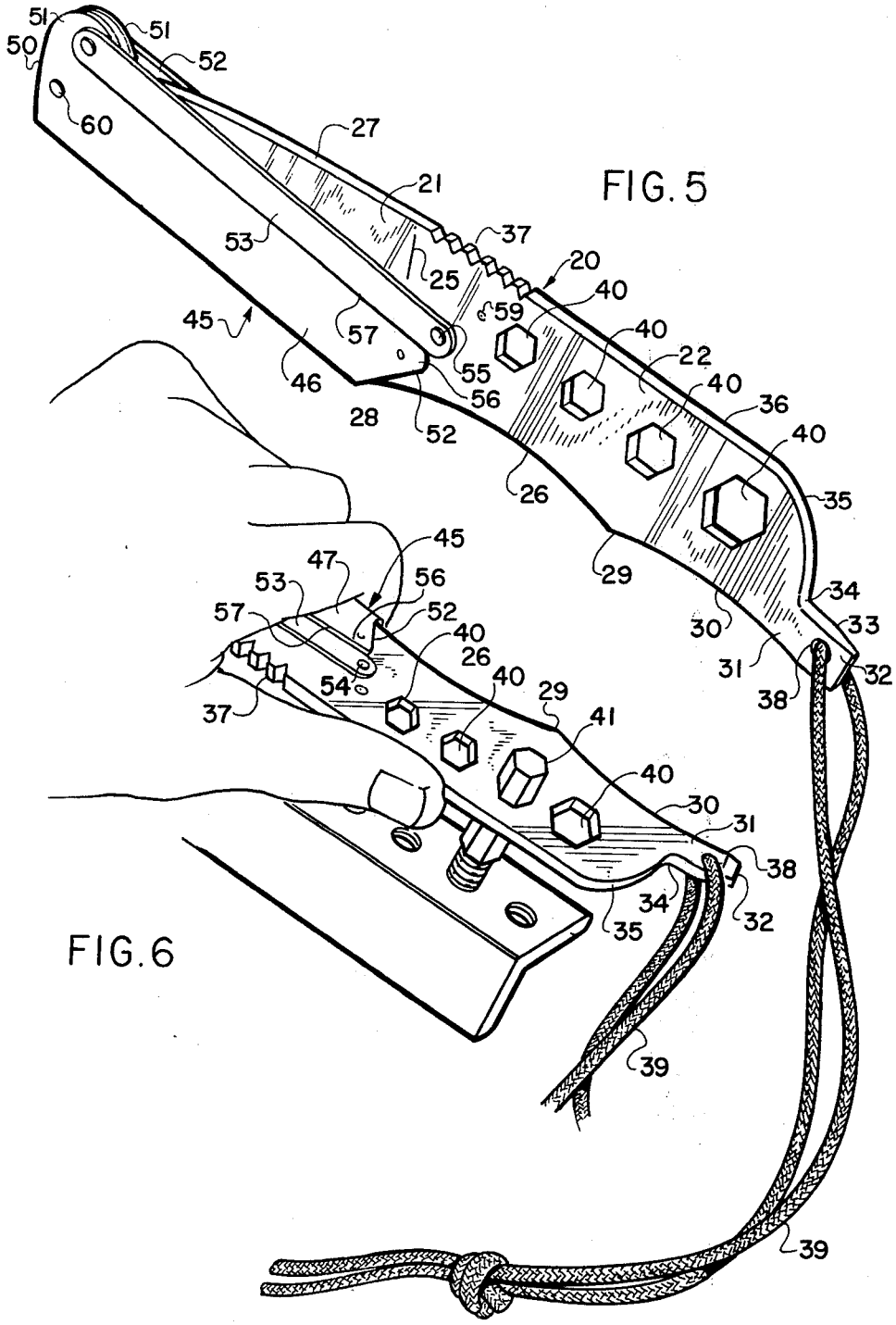
FIG. 6 is a fragmentary pespective view illustrating the use of the tool-shaped shank of the knife with the housing in its second position of FIG. 5.
Figure 5A:
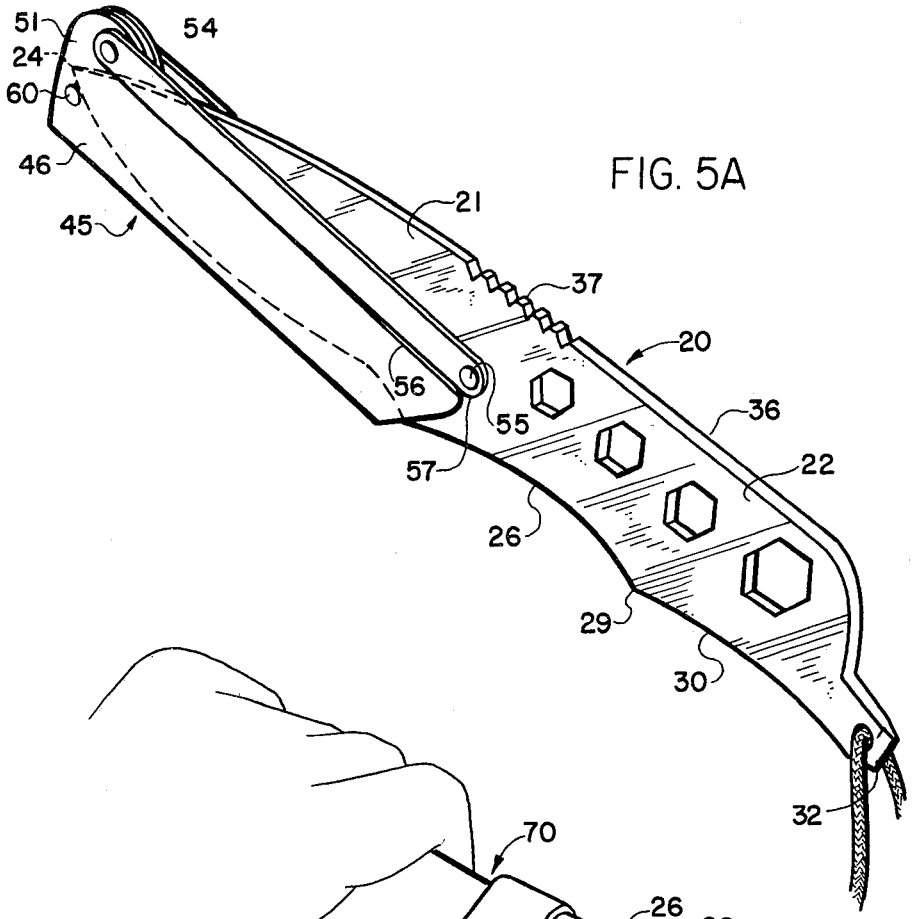
FIG. 5A is an enlarged fragmentary side elevation, with parts broken away, of the utility knife in its second operative position of FIG. 5.

The flat body of the shank 22 has a plurality of hexagonally shaped openings 40 extending therethrough, there being four such openings illustrated in the drawings. The hexagonal openings 40 are each of a different size to receive correspondingly sized conventional hexagonally shaped nuts 41 (FIG. 6), such as for example, 11/32 of an inch, ⅜ of an inch, 7/16 of an inch and ½ inch. The utility knife may be used as a wrench by registering a nut 41 with a correspondingly sized opening 40 as shown in FIG. 6.

The sharpened edge 23 of the knife blade 21 is conveniently and safely covered for grasping when using the tool-shaped shank 22 by a U-shaped or channel shaped housing broadly indicated at 45 and including a pair of laterally spaced side walls 46 and 47 joined by an integrally formed web 48. The side walls 46, 47 and web 48 may be formed as an integral channel shaped structure from a single piece of hard metal with the side walls 46 and 47 extending in perpendicular relation to the web 48 and in parallel relation to each other. The side walls are spaced apart a distance substantially equal to the width of the web 48 which is only slightly greater than the width of the flat edges 26 and 36 of the tool-shaped shank 22.

The side walls 46 and 47 of the housing 35 are longer than the blade 21 and shorter than the shank 22, and extend from the web 48 a distance equal to approximately one half the width of the shank 22. The side walls 46 and 47 extend angularly outwardly as at 50 and 52 from their junctures with the ends of the web 48. The end edges 50 of the side walls 46, 47 terminate in a curve which defines lugs 51 spaced further from the web 45 than their respective side walls 46, 47. Positioning links 53 extend from the lugs 51 on either side of the utility knife 20 in parallel relation to each other and the positioning links 52 are pivotally connected to the lugs 51 by a pivot pin 54 extending transversely through the lugs 51 and links 52. The ends of the pivot pins 54 are suitably flattened to retain them in the lugs 51 and links 52.

The links 53 are about the same length as the side walls 46, 47 of the housing 45 and the ends of the links 53 remote from the pivot pin 54 are pivotally connected to the shank 27 as by a pivot pin 55 extending transversely through or near the longitudinal axis of the shank 22 at a point spaced rearwardly of the merge line 25.

METHOD OF OPERATION

Referring to FIG. 1, the housing 45 is positioned about the top edge 36 of the shank 22 and extends in overlapping relation to the upper half of the shank to provide a convenient handgrip for use of the sharpened edge 23 of knife blade 21 which is exposed for use. In this first position the lugs 51 overlap and bear against the sides of the tang 31 as the pivot pin 54 is firmly seated on the top wall 33 of tang 31 (FIG. 1). The links 53 are fastened to the pivot pin 54 outwardly of the lugs 51 on housing 45 and the links 53 taper inwardly toward the axis of the utility knife 20 as they extend forwardly to the pivot pin 55 spaced rearwardly from the merge line 25. The inward taper of the links 55 bring them beneath the forward portion of the housing 45 in FIG. 1 so that the free end edges 56 of the housing 45 are seated against the proximal edges 57 of the links 53.

With the free end edges 56 of the housing 45 bearing against the proximal edges 57 of links 53 adjacent the pivot pin 55 and with the pivot pin 54 bearing against the upper surface 33 of tang 31, the housing 45 is firmly seated around the upper edge 36 of shank 22. The housing 45 is releasably retained in that position by inwardly directed projections 58 on the side walls 46 and 47 of housing 45 registrable with correspondingly shaped detents 59 in shank 22. A sturdy and reliable handle is thus provided for using the blade 21 of the utility knife 20.

Figure 3:
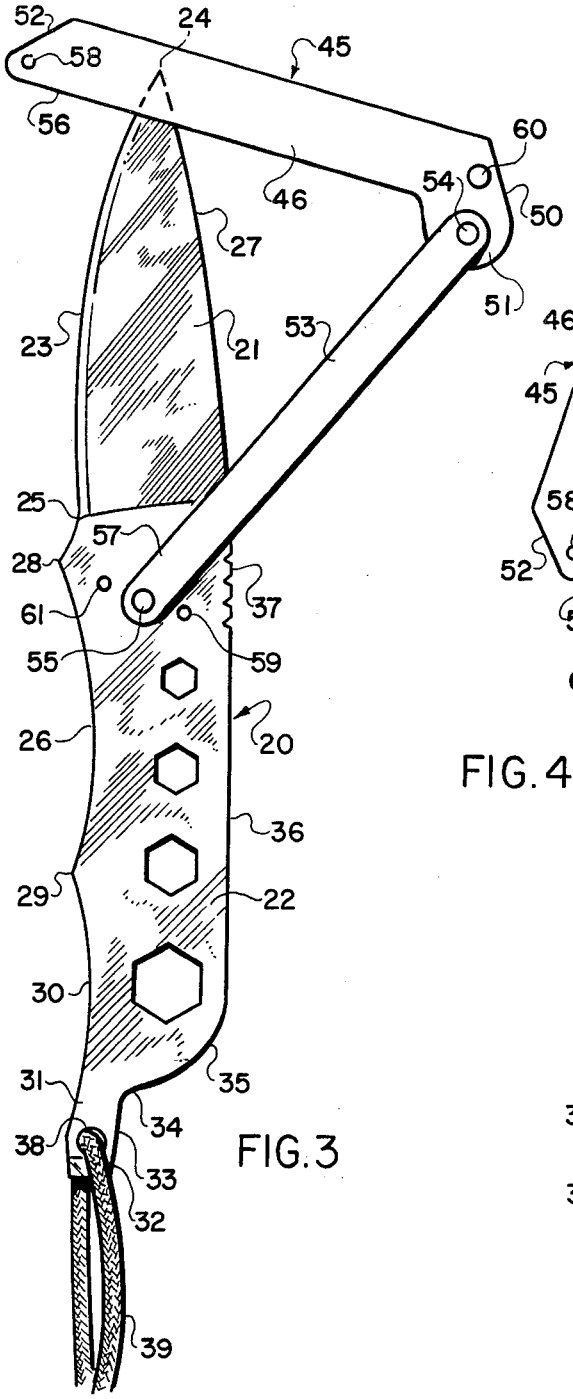
Figure 4:
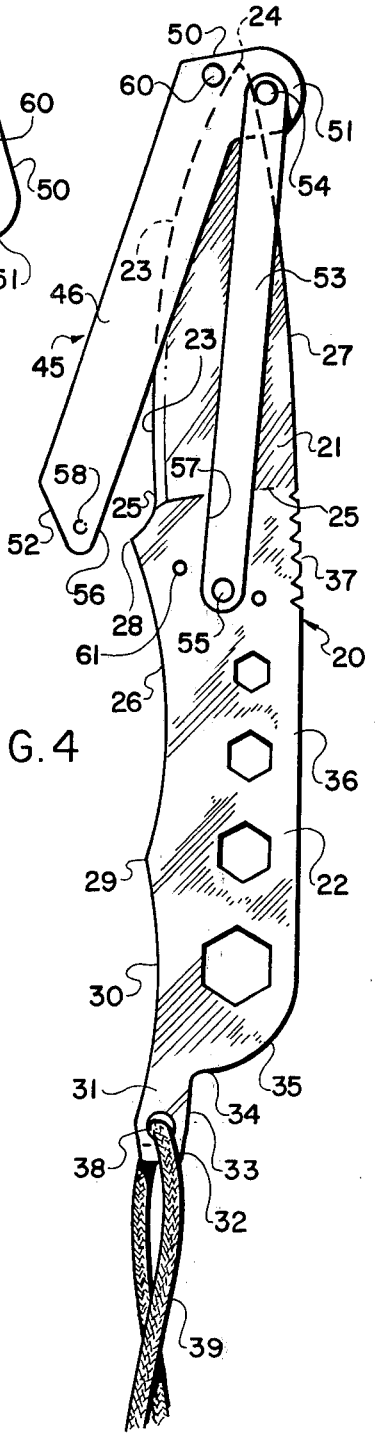
Figure 3A:
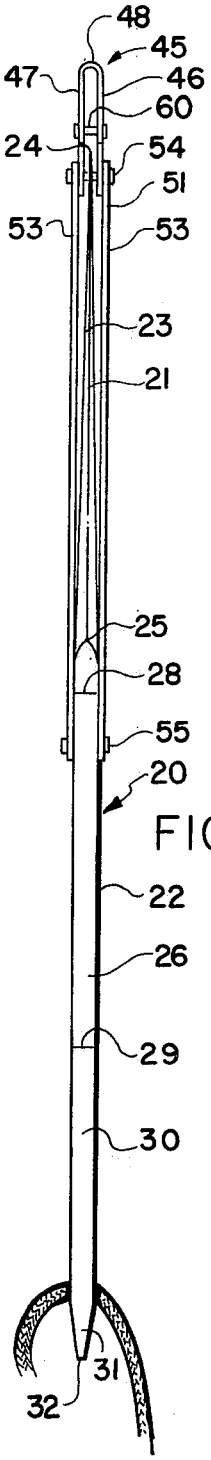
FIG. 3A is an inverted plan view illustrating the relationship of the pivot pin and the binding pin with the blade when the housing is in perpendicular relation to the blade.
Figure 7:
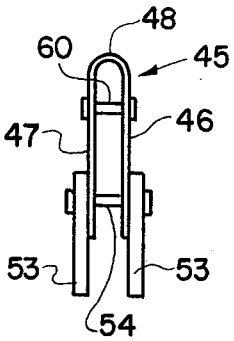
FIG. 7 is a vertical sectional view taken substantially along the line 7—7 in FIG. 2.
Figure 8:
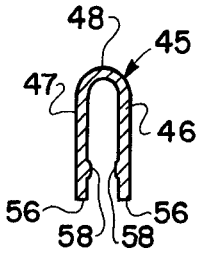
FIG. 8 is a vertical sectional view taken substantially along the line 8—8 in FIG. 2.
Figure 3B:
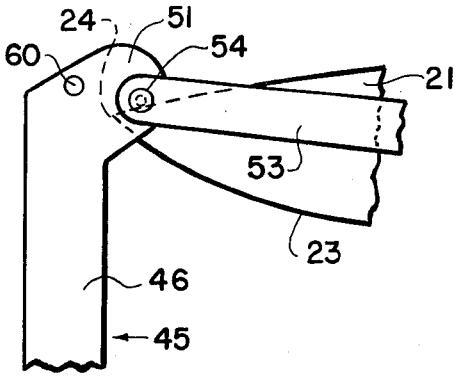
FIG. 3B is a fragmentary side elevation illustrating the relationship of the pivot pin and the binding pin with the blade when the housing is in perpendicular relation to the blade.

Assuming that it is desired to use the tool-shaped shank 22 of the utility knife, the housing 45 may be lifted from its first operative position on shank 22 and pivoted with the positioning links 53 through the successive positions illustrated in FIGS. 2, 3, and 4 to the second operative position of FIG. 5 with the U-shaped housing 45 positioned about the sharpened edge 23 of knife blade 31. As shown in FIGS. 3B and 4 the pivot pin 54 engages and pivots against the flat upper edge of knife blade 21 as the positioning links move the housing 45 about the pointed end 24 and over the sharpened edge 23 of blade 21.

A stabilizing pin 60, preferably formed from a soft material such as brass, extends between the lugs 51 and is fastened thereto as by flattening the ends of pin 60 outwardly of the lugs 51. The stabilizing pin 60 is positioned in fixed, spaced parallel relation to the pivot pin 54 to engage the sharpened edge 23 of blade 21 when the free end edges 56 of housing 45 move over the shank 22 toward the proximate edges 57 of positioning link 53. Then, with the edges 56 of housing 45 positioned against the proximal edges 57 of link 53 in the second operative position of FIG. 5, the sharpened edge 23 of blade 21 is securely supported on stabilizing pin 60 to restrict relative movement of the blade 21 and housing 45. Detents 61 in shank 22 adjacent lower curved wall 26 are registrable with projections 58 on the side walls 46, 47 to releasably but snugly retain the housing 45 about the sharpened edge 23 of blade 21 and thereby provide a safe and sturdy handle for manipulating the tool-shaped shank 22.

The housing 45 may be returned from the second operative position shown in FIG. 5 to the first operative position of FIG. 1 by reversing the sequence of steps illustrated in FIGS. 2, 3, and 4. It is thus apparent that manipulation of the housing 45 and positioning links 53 to a selected position enables operative use of either end of the utility knife.

MODIFIED FORM OF THE INVENTION

Figure 9:
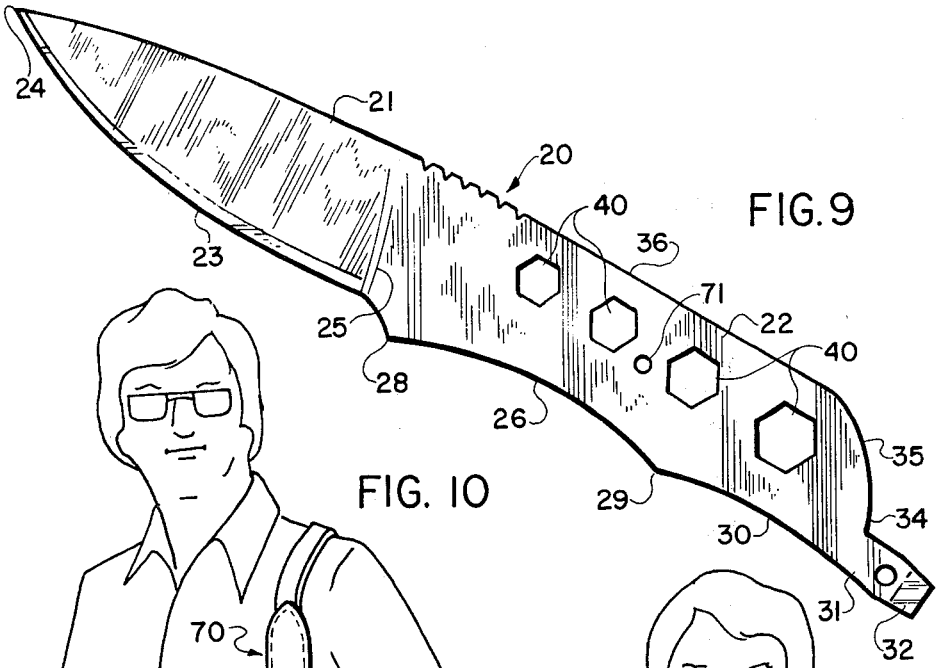
FIG. 9 is a perspective view of a modified form of the invention wherein the housing and positioning link are omitted and the remaining structure is adapted for use as a sheath knife.
Figure 10:
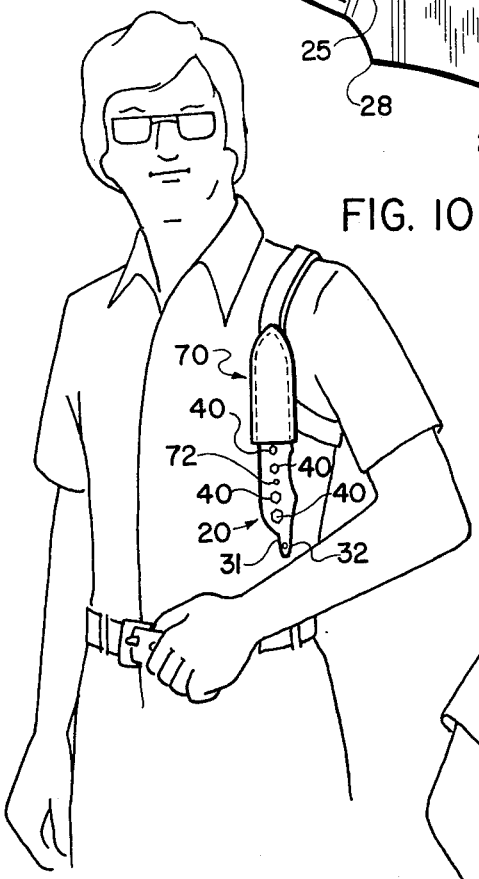
FIGS. 10 and 11 are environmental perspective views illustrating the knife of FIG. 9 being carried in depending relation and in upstanding relation, respectively, to a sheath.
Figure 11:
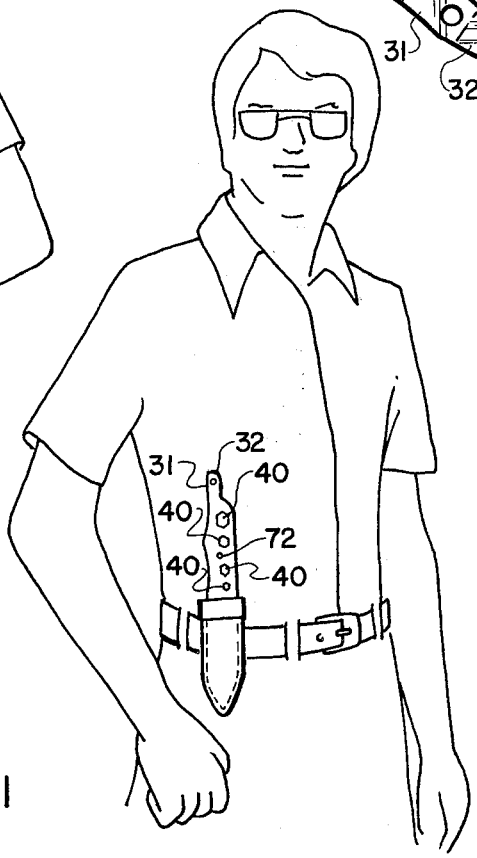
Figure 12:
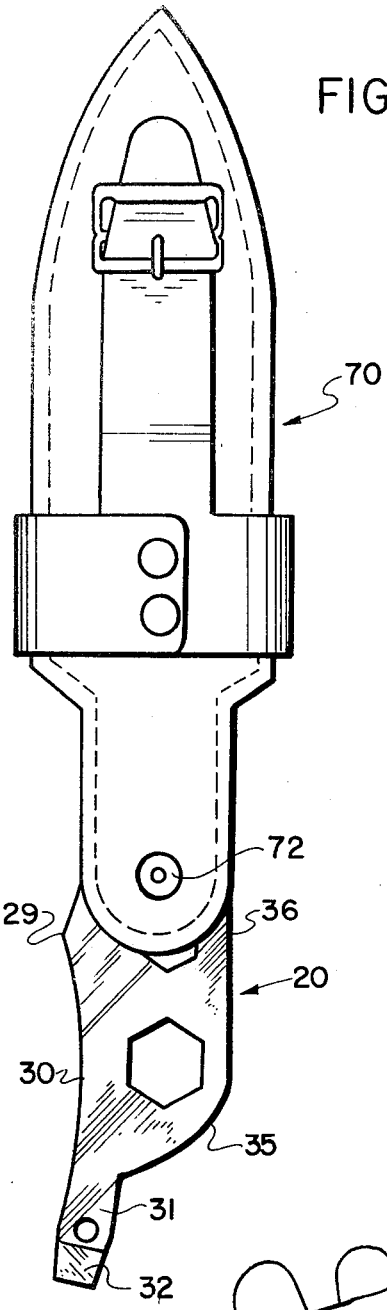
FIG. 12 is an enlarged view of the knife within the sheath, looking at the other side of the sheath from that shown in FIGS. 10 and 11.
Figure 13:
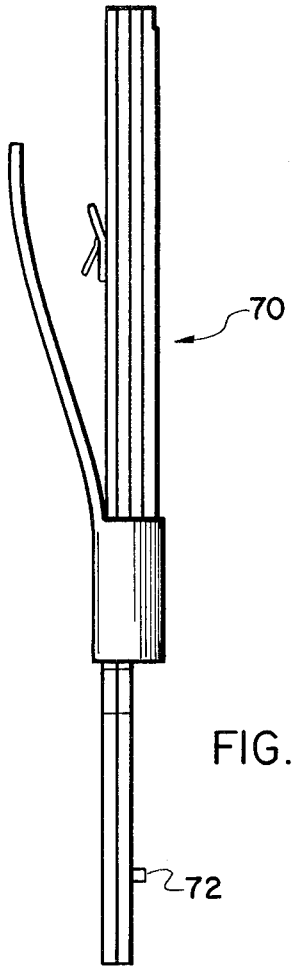
FIG. 13 is a side elevation of the sheath with the knife removed.

Referring to FIG. 9, the utility knife 20 may be modified by removing the housing 45 and its positioning links 53 to convert the utility knife to a sheath knife usable with a sheath such as described and claimed in my prior U.S. Pat. No. 4,211,003 issued July 8, 1980 and entitled ADAPTABLE KNIFE SHEATH. The sheath of my earlier patent is illustrated in FIGS. 10 through 15 of the accompanying drawings and as is apparent from FIGS. 10 and 11 the sheath, broadly indicated at 70, may be carried with the knife hanging down from the sheath as in FIG. 10, or with the knife extending upwardly from the sheath as in FIG. 11.

Figure 14:
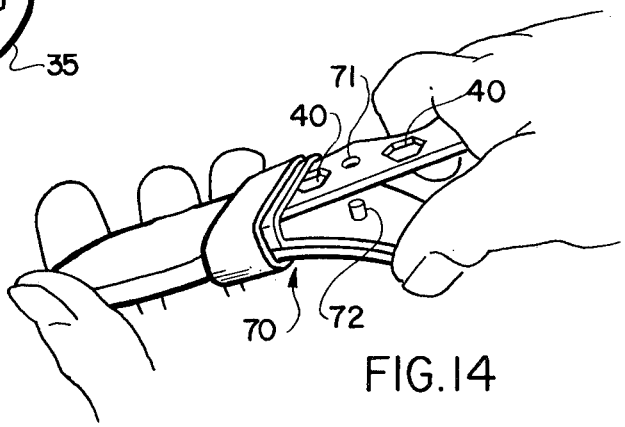
FIG. 14 is a perspective view illustrating the removal of the knife of FIG. 9 from the sheath.

The modified form of knife shown in FIGS. 9 through 14 is like the knife shown in FIGS. 1 through 8 except that the housing and positioning links have been removed and the transverse bore which accommodates the pivot pin 55 in the first form of the invention has been relocated in the modified form of the invention to a point indicated at 71 adjacent the center of the shank 22 as indicated in FIGS. 9 and 14. Like reference characters have been applied to the knife of FIG. 9 as are used to identify corresponding parts in the first described form of the invention.

As more fully explained in said U.S. Pat. No. 4,211,003 the sheath 70 includes a locking pin 72 and means for spring biasing the locking pin 72 inwardly toward the handle of a knife seated in the sheath. The transverse bore 71 through the shank 22 of knife 20 receives the locking pin 72 when the knife 20 is seated in the sheath 70 to desirably retain the knife in the sheath. The knife may be removed from the sheath by flexing the locking pin outwardly away from engagement with the shank of the knife, as most clearly seen in FIG. 14.

Figure 15:
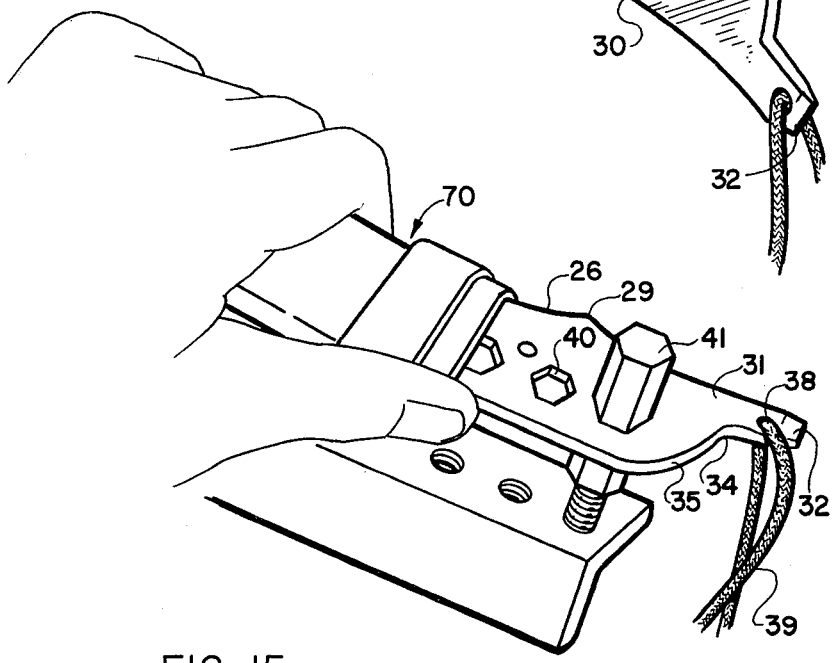
FIG. 15 is a view similar to FIG. 6 but illustrating the sheath covered blade being grasped to use the shank as a tool.

The shank 22 forms a useful handle for using the blade when it is removed from the sheath, and the blade may remain in the sheath and grasped as shown in FIG. 15 to use the tool-shaped shank as a wrench, or otherwise.

Preferred embodiments of the invention have been set forth and described in the specification and drawings and although specific terms have been employed they are used in a descriptive and generic sense only and not for the purpose of limitation.

I claim:

1. A utility knife comprising a fixed knife blade having a sharpened edge and a tool-shaped shank, said blade and shank extending in axial alignment with each other and formed as an integral unit, positioning links on each side of the shank and a first pivot pin extending transversely through the medial portion of the shank and pivotally connecting the positioning links to the shank, a channel-shaped housing having a free end and pivotally connected at its other end by a second pivot pin to the ends of the links opposite the first pivot pin, means supporting the housing in a first position about one edge of the shank, and means supporting the housing in a second position about the sharpened edge of the blade.

2. A utility knife comprising a fixed knife blade having a sharpened edge and a tool-shaped shank, said blade and shank extending in axial alignment with each other and formed as an integral unit, means for selectively covering the sharpened edge of the fixed knife blade whereby the blade may be grasped to use the shank as a tool, said means comprising a housing pivotally connected to the shank, means for selectively positioning the housing in a first operative position over one edge of the shank and in a second operative position over the sharpened edge of the blade, said means comprising a pair of positioning links pivotally connected at one of their ends to the medial portion of the shank adjacent its juncture with the blade, there being one positioning link on each side of the shank, and a pivot pin extending through the opposite ends of the positioning links and through one end of the housing to pivotally connect the housing to the positioning links.

3. A structure according to claim 2 wherein the top wall of the shank is serrated by transverse grooves adjacent its juncture with the blade to provide a convenient thumb grip.

4. A structure according to claim 2 wherein said shank includes a plurality of hexagonally-shaped openings extending therethrough and wherein each of said hexagonally-shaped openings is of a different size.

5. A structure according to claim 2 wherein the shank includes a tang projecting from its end opposite the blade and along the same edge of the knife as the sharpened edge of the blade.

6. A structure according to claim 5 wherein the pivot pin extending through the positioning links and one end of the housing is seated on the tang when the housing is positioned in its first operative position over one edge of the shank.

7. A structure according to claim 6 wherein the positioning links taper inwardly from the pivot pin connecting the positioning links to one end of the housing toward the pivotal connection of the positioning links to the shank and wherein the housing has a free end portion opposite its pivotal connection with the positioning links, and the free end of the housing being in superposed relation and bearing against the proximal edges of the positioning links when the housing is in an operative position.

8. A structure according to claim 2 wherein the housing is channel-shaped and wherein the positioning links taper inwardly from the pivot pin toward the juncture of the links with the shank, said pivot pin engaging with and bearing against the edge opposite the sharpened edge of the blade and adjacent the pointed end of the blade during movement of the housing from its first position about the shank to its second position about the sharpened edge of the knife blade.

9. A structure according to claim 2 wherein means are provided for limiting relative movement between the housing and the blade when the housing is seated in its second position about the sharpened edge of the blade.

10. A structure according to claim 9 wherein said means comprises a soft metal retaining pin extending across the channel-shaped housing and engagable with the sharpened edge of the blade when the housing is seated in its second operative position about the sharpened edge of the blade.

* * * * *